US005456292A

United States Patent [19]

Alexander, III

[11] Patent Number: 5,456,292

[45] Date of Patent: Oct. 10, 1995

[54] LIGHT BOX INSPECTION APPARATUS AND METHOD

[75] Inventor: William J. Alexander, III, Mauldin, S.C.

[73] Assignee: Alexander Machinery, Inc., Mauldin, S.C.

[21] Appl. No.: 304,758

[22] Filed: Sep. 12, 1994

[51] Int. Cl.[6] ..... D03D 49/20

[52] U.S. Cl. ..... 139/1 B; 139/304; 139/311; 26/70; 242/538.2; 250/559.01

[58] Field of Search ..... 139/1 B, 348, 139/311, 291 R, 304; 356/430, 431; 26/70; 250/571, 563; 242/538.2, 548, 413.9, 534.2

[56] References Cited

U.S. PATENT DOCUMENTS 547,209 10/1895 Hall ..... 139/1 B
3,502,115 3/1970 Barnett ..... 26/70
3,624,875 12/1971 Haft ..... 26/70
4,727,911 3/1988 Crawford et al. ..... 26/70

FOREIGN PATENT DOCUMENTS 1409994 7/1965 France ..... 26/70

OTHER PUBLICATIONS

Erhardt & Leimer, "Examination of Tubular Textile Goods", International Textile Bulletin, (Mar. 1969) p. 213.

*Primary Examiner*—Andrew M. Falik
*Attorney, Agent, or Firm*—Ralph Bailey

[57] ABSTRACT

A unitary light box for inspecting cloth manufactured on a loom (10) is provided with first and second viewing areas (B) and (C), respectively, wherein cloth (F) having a vertical run is guided over an intermediate curved surface (D) for inspection providing several angles of sight to the operator from the same vantage point so as to locate defects not ordinarily visible during conventional head on observation.

9 Claims, 2 Drawing Sheets

LIGHT BOX INSPECTION APPARATUS AND METHOD

BACKGROUND OF THE INVENTION

This invention relates to an improved inspection apparatus and method including multiple light boxes especially useful for loom takeups.

Inspection apparatus in general use utilize a single vertical light box located generally slightly below eye level receiving cloth for inspection from beneath a worker's platform preparatory to guiding the cloth web to a suitable takeup such as illustrated in U.S. Pat. No. 4,619,295. The takeup is generally in the form of an off loom surface winder or takeup. In addition to a vertical position light boxes in general use are sometimes sloped back over the cloth row at an angle of approximately 30°. An improved light box has been provided and illustrated in pending patent application Ser. No. 08/222,233 entitled WEB INSPECTION APPARATUS AND METHOD in the name of William J. Alexander, III, the disclosure of which is incorporated herein by reference. The application discloses a light box having a curved stationary upper surface which acts as a guide for the cloth web passing over the top of the inspection apparatus and thence downwardly for reception upon the cloth roll carried between the parallel driven rolls which act as a surface winder for the cloth roll. Such apparatus provides many advantages including the provision of a simplified inspection apparatus having a relatively low profile so as not to unduly limit the observance of other parts of the weave loom by an operator during inspection of cloth.

U.S. Pat. Nos. 3,802,035, 3,865,151, and 4,593,725 are further illustrative of the state of the art relating to inspection apparatus for loom cloth takeups.

Because prior art light boxes provide a single lighted surface for viewing generally directly at a right angle to a line of vision of an operator located at a given position relative to the inspection apparatus, it has not been possible for the operators to conveniently view the cloth from different angles while standing in a given position. Moreover, the viewing area afforded by a light box has been limited because of its positioning generally approximately at eye level to the user.

Accordingly, it is desirable that a person viewing the cloth from a vertical or sloped light box be able to view the cloth in an enlarged viewing area provided by the addition of a substantially upright viewing surface located beneath the conventional surface to enhance the capabilities of finding defects and thus improve the quality of the cloth being manufactured by providing several viewing angles or lines of vision to the operator.

Another object of the invention is to provide an improved light box arrangement wherein an additional viewing area is provided below the conventional viewing area of an inspection apparatus receiving cloth from beneath a worker's platform.

Many cloth inspectors agree that some defects can more easily be seen by looking directly at while others must be viewed from a different angle to be visible. It is desirable that a cloth inspector standing on the worker's platform be able to look downwardly toward the feet and see the fabric at a different angle from the conventional direct viewing of the fabric.

SUMMARY OF THE INVENTION

Accordingly, it is an important object of the invention to provide an improved apparatus and method for viewing and inspecting the fabric or cloth web being manufactured by a loom as it is fed upwardly from beneath a worker's platform during its upward travel over the inspection apparatus at several angles by an operator preparatory to passage of the cloth to the takeup.

Another important object of the invention is the provision of a compound light box providing more than one viewing surface for an operator standing on a worker's platform.

Another important object of the invention is the provision of an increased amount of lighted surface behind the fabric without the necessity of increasing the height of the inspection apparatus as would obstruct the operator's view over the weave room. For simplicity and ease of manufacture the improved light box apparatus is constructed as a unitary device with double angles that are adjustable with respect to each other and being capable of maintaining fixed angles with respect to each other, while being positioned at varying angles in respect to the takeup and associated apparatus.

A further object of the invention is to permit an operator to inspect fabric so as to observe defects looking directly toward the fabric at substantially a right angle while also being able to look downwardly toward the feet of the operator to see the fabric at another angle so as to discover additional defects.

Another object of the invention is the provision of a versatile inspection apparatus wherein the cloth may be inspected at more infrequent intervals because of the increased size of the viewing area afforded by the compound light box.

Preferably extruded aluminum top and bottom curve members may be provided at the upper and lower respective ends of the compound structure so that an immediate curved member may be used to guide the fabric in its passage from one viewing area to the other so as to utilize three spaced fluorescent tubes in order to effectively illuminate all viewing areas. This structure will permit the passage of a cloth web over a stationary, arcuate, transverse surface intermediate the first and second viewing areas for the purpose of directing the web outwardly and upwardly over the second viewing area. A single lighting tube may be utilized at both the top and the bottom within the unitary light box structure whereas an intermediate tube may be shared by both light boxes to illuminate both viewing areas of the respective light boxes.

A modified form of the invention contemplates a double light box wherein a first viewing area may be sloped inwardly or outwardly toward a bottom to give an adjusted, increased variety of angles for inspection of the fabric.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate inspection apparatus receiving a cloth web F moving upwardly in open width. The inspection apparatus includes an upright frame having opposed end frame members A. A first substantially upright light box is carried transversely between said end frame members providing a first viewing area B at one angle of observation receiving the upwardly moving cloth web from beneath a worker's platform for inspection. A second light box is carried transversely between the end frame members for receiving the upwardly moving web after its passage over said first light box for inspection. The second light box provides a second viewing area C at another angle of observation, preferably inclined generally outwardly and upwardly in respect to the one angle of observation. A transverse guide D is carried by the frame receiving and directing the web after its passage over said first viewing area so that space is conserved, and increased areas and angles of observation provided.

Figure 1:
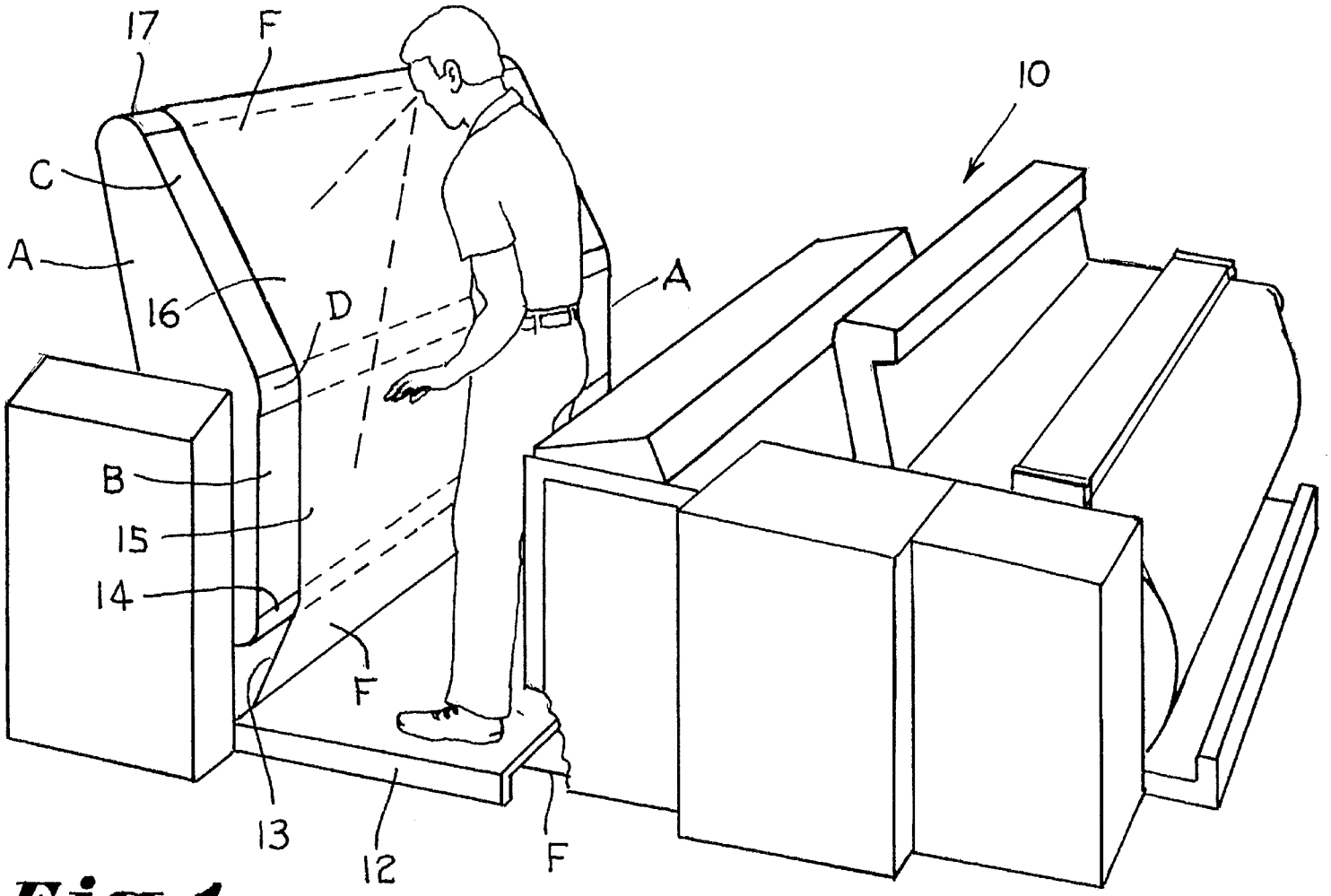
FIG. 1 is a perspective view illustrating an operator utilizing a compound inspection apparatus constructed in accordance with the present invention with the cloth having been manufactured by a loom passing upwardly from beneath a worker's platform upon which the operator is looking toward several viewing areas, a first of which receives the cloth as it passes upwardly from beneath the worker's platform and thence extending generally in an inclined fashion upwardly and outwardly preparatory to its passage to a cloth takeup.

Referring more particularly to FIG. 1, a loom is broadly designated at 10 and cloth F which is manufactured thereon passes beneath the elevated worker's platform 12 from where it exits upwardly and outwardly in a first run of cloth 13. The cloth thence passes generally substantially vertically upwardly over a fixed arcuate lower guide surface 14 in an upwardly extending run 15. The cloth then continues upwardly and is inclined outwardly in a run 16 as it is guided between the stationary curved surface D and an upper curved surface 17. Thus, the cloth F passes over first and second light box surfaces which provide respective first and second viewing areas or surfaces first at one angle of observation and then at another second angle of observation. The inclination of the second light box permits the operator to view the cloth head on at substantially a right angle as illustrated in the upper viewing area C in FIG. 1 while simultaneously at an angle in a lower viewing area B in an upright run 15 of the cloth by looking downwardly at the feet of the operator making it possible to discover defects at another angle in addition to those observed by a more conventional single direct observation.

Figure 2:
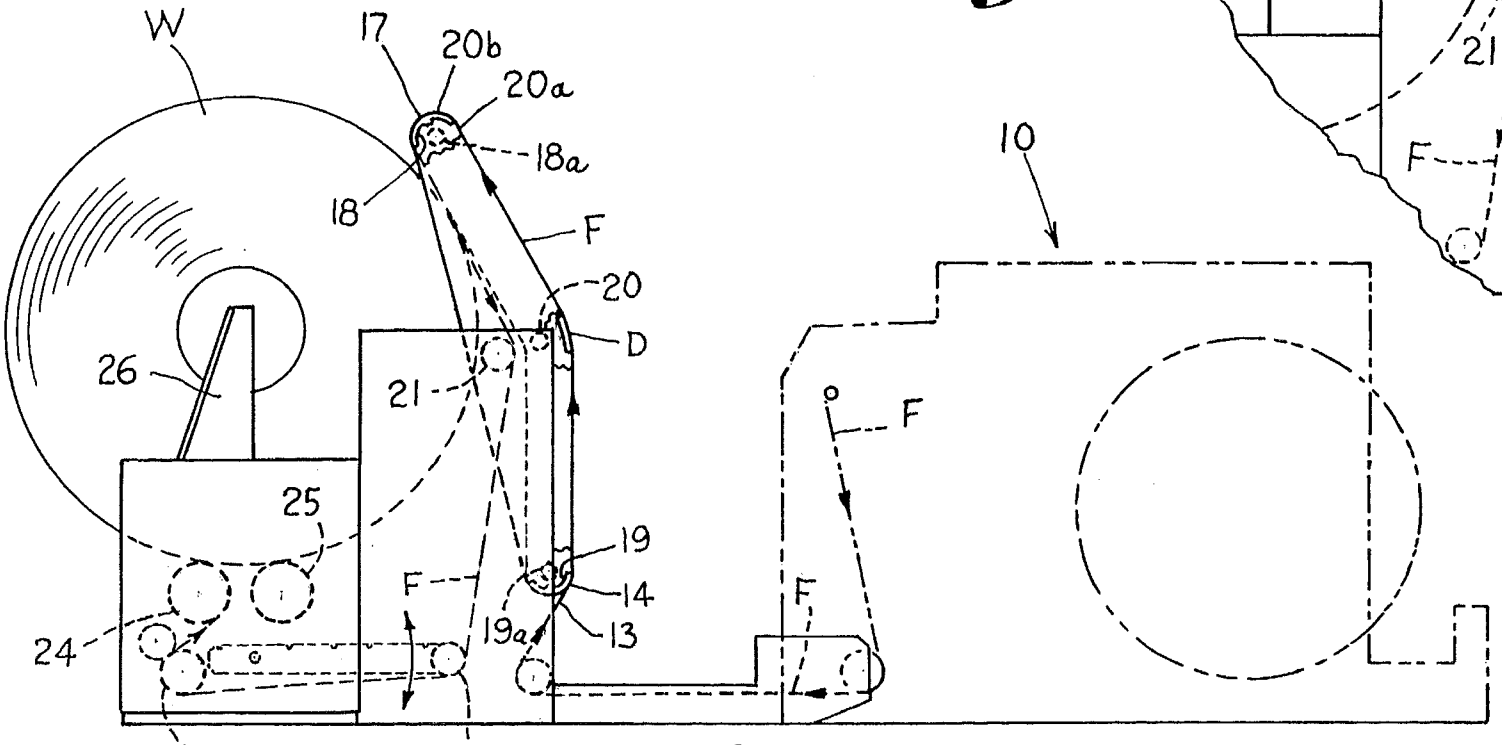
FIG. 2 is a side elevation of the apparatus in FIG. 1, with parts broken away, illustrating the passage of the cloth over and downwardly from the inspection apparatus and being wound upon a cloth roll carried by a surface winder.

Referring more particularly to FIG. 2, it will be observed that the upward and outward run 13 of the cloth passes over a lower arcuate surface 14 in its passage to the intermediate arcuate guide surface D afforded by what is preferably an aluminum extrusion. The cloth passes thence upwardly and over the upper curved surface 17. Preferably an aluminum extrusion, which has an inner reflective surface 18 provides the upper curved surface 17. The lower curved surface 14 is also preferably carried by an extrusion having an inner surface 19 which is light reflective. A fluorescent tube is carried as at 19*a* and 18*a* respectively while an intermediate fluorescent tube 20 provides illumination of the respective first and second viewing surfaces B and C respectively. A plexiglass cover 20*a* is provided over each of the light boxes affording the respective viewing areas. The covers are received in slots in the ends of the respective aluminum extrusions as at 20*b*. The cloth F is illustrated as passing downwardly over a guide roll 21 and then over an oscillating roll 22 such as a compensator roll illustrated in U.S. Pat. No. 4,216,804; the disclosure of which is incorporated herein by reference. The position of the oscillating compensator is governed by tension in the cloth web. The cloth F then passes over the guide roll 23 and then upwardly to a first driven support roll 24 which together with the parallel support roll 25 supports the web or cloth roll W during its building action. Suitable web guides 26 are provided for limiting the lateral oscillation of the web roll during the building.

Figure 3:
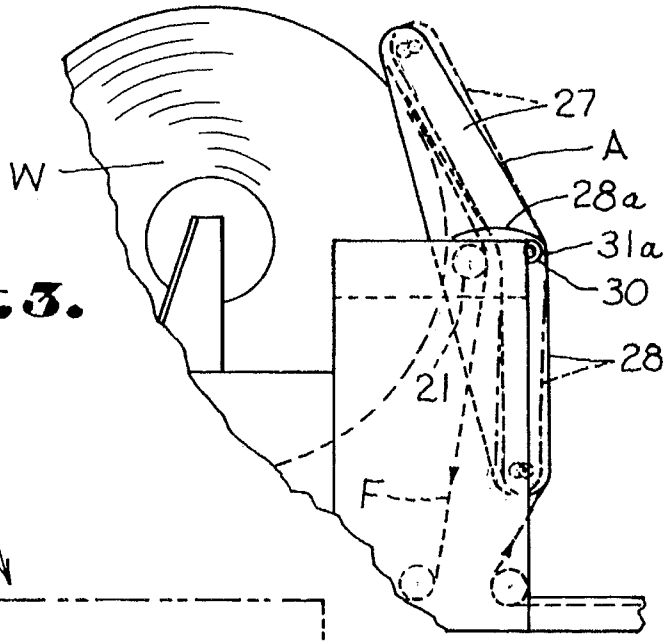
FIG. 3 is a partial side elevation illustrating a modified form of the invention wherein upper and lower light boxes are constructed in a unitary apparatus and wherein the light boxes are pivotally adjustable with respect to each other and as a unitary structure with respect to the cloth takeup.

FIG. 3 illustrates a modified form of the invention wherein the side frame members A have upper and lower segments 27 and 28 of the respective light boxes which are joined by a pivot pin 30 positioned to provide for adjustment of the lower pivoted segment of the first light box which has a curved upper surface as at 28*a* overlying the upper section 27. The upper and lower light boxes may be adjusted as a unit to broken line position or they may be individually adjusted. A suitable collar with set screw 31*a* may be provided to fix the upper and lower light boxes relative to each other.

It is thus seen that an improved light box has been provided wherein first and second viewing areas are provided for simultaneous viewing by the operator at different lines of sight enabling an inspector to see a greater variety of defects from the same vantage point. The overall viewing area is increased while minimizing the overall height of the inspection apparatus.

While a preferred embodiment of the invention has been described using specific terms, such description is for illustrative purposes only, and it is to be understood that changes and variations may be made without departing from the spirit or scope of the following claims.

What is claimed is:

1. Inspection apparatus receiving an upwardly moving web in open width comprising:

an upright frame having opposed end frame members;

a first substantially upright light box carried transversely between said end frame members providing a first viewing area at one angle of observation receiving said upwardly moving web for inspection;

a second light box carried transversely between said end frame members for receiving said upwardly moving web after its passage over said first light box for inspection providing a second viewing area at another angle of observation inclined generally outwardly and upwardly in respect to said one angle of observation; and a transverse guide carried by said frame receiving and directing said web over said second viewing area after its passage over said first viewing area;

whereby space is conserved, and increased areas and angles of observation provided.

2. The structure set forth in claim 1 including a unitary structure constituting said first and second light boxes, said unitary structure having upper and lower curved stationary surfaces on upper and lower ends thereof which, together with the transverse guide, position the web for viewing as it passes over the inspection apparatus.

3. The structure set forth in claim 2 including a work platform wherein said light boxes are positioned transversely between said work platform under which cloth passes from a loom and a takeup for said cloth, said cloth exiting from beneath said work platform outwardly and upwardly over said lower curved stationary surface.

4. The structure set forth in claim 3 wherein said light boxes include fluorescent tubes carried therein adjacent respective upper and lower curved stationary surfaces and said guides.

5. The structure set forth in claim 3 including adjustment means for varying an angle between said first and second light boxes with the vertical so as to vary the angles of observation of the viewing areas.

6. The method of inspecting an upwardly moving cloth web comprising the steps of:

providing a first substantially upright light box carried transversely between a loom and a cloth takeup;

observing a first viewing area at a first angle of observation provided by said first light box receiving said upwardly moving web for inspection;

positioning a second light box transversely in alignment with said first light box receiving said upwardly moving web after its passage over said first light box for inspection;

utilizing a second viewing area, at a second angle of observation in respect to said first angle of observation, afforded by said second light box; and directing said web after its passage over said first viewing area to said second viewing area;

whereby space is conserved, and increased areas and angles of observation provided.

7. The method set forth in claim 6 including the steps of passing said cloth web over a stationary, arcuate, surface at an upper end of said second light box so as to provide for enhanced inspection areas at a relatively low profile to avoid limiting viewing of the weave room.

8. The method set forth in claim 6 including the step of passing said cloth web over a stationary, arcuate, transverse surface intermediate said first and second viewing areas for directing said web outwardly and upwardly over said second viewing area.

9. The method set forth in claim 6 including the steps of directing said cloth web downwardly after its passage over said second viewing area, and thence beneath an oscillatably mounted roll movable in response to variations in tension in the cloth web preparatory to winding.

* * * * *